United States Patent [19]

Sinclair et al.

[11] 4,225,205

[45] Sep. 30, 1980

[54] ELECTRICAL CONNECTOR FOR TERMINATING A FLAT CONDUCTOR CABLE

[75] Inventors: William Y. Sinclair, Frenchtown, N.J.; Joseph Argila, Upper Black Eddy, Pa.

[73] Assignee: Aries Electronics, Inc., Frenchtown, N.J.

[21] Appl. No.: 3,628

[22] Filed: Jan. 15, 1979

[51] Int. Cl.[3] ..... H01R 11/00; H01R 13/58

[52] U.S. Cl. ..... 339/59 M; 339/98; 339/103 M; 339/107; 339/176 MF

[58] Field of Search ..... 339/96, 97 R, 97 P, 339/100, 276 T, 98, 101, 107, 99 R, 59 M, 103 R, 107, 17 F, 176 MF

[56] References Cited

U.S. PATENT DOCUMENTS

| | | | |
|---|---|---|---|
| 3,573,719 | 4/1971 | Lightner | 339/275 T X |
| 3,680,032 | 7/1972 | Mosier | 339/99 R |
| 3,784,961 | 1/1974 | Gartland | 339/107 |
| 3,816,818 | 6/1974 | Meier | 339/99 R |
| 3,820,059 | 6/1974 | Gibbons | 339/101 X |
| 3,879,099 | 4/1975 | Shaffer | 339/107 X |
| 3,899,236 | 8/1975 | Santos | 339/98 |
| 3,904,261 | 9/1975 | Cooney | 339/176 MF X |
| 3,934,076 | 1/1976 | Smith | 339/107 X |
| 4,047,784 | 9/1977 | Trank | 339/98 |
| 4,138,185 | 2/1979 | Jaconette | 339/107 |

*Primary Examiner*—John McQuade
*Assistant Examiner*—John S. Brown
*Attorney, Agent, or Firm*—Anthony J. Casella

[57] ABSTRACT

An electrical connector for terminating a flat conductor cable includes inherent strain relief means, and is constructed to facilitate interconnection of the conductors of the flat conductor cable to the terminal pins of the connector. The latter includes a plastic carrier having a central bar member which receives a parallel array of terminal pins, and formed unitary with the bar member are two planar cable support members. The latter are hingedly connected to the bar member such that they may be initially pivoted to a folded position to facilitate soldering of the terminal pins to the conductors of the flat conductor cable. Next, the planar support members may be pivoted about their hinge connections so as to engage the opposite surfaces of the flat conductor cable, where the planar support members are secured together. Strain relief is provided by projections extending from one planar support member and passing through the plastic carrier intermediate the conductors of the flat conductor cable, and secured to the opposite planar support member. In addition, the inside surfaces of the planar support members include staggered ribs which engage the insulated conductors of the flat conductor cable for additional strain relief. Each planar support member also includes longitudinal grooves of a size to cause an interference fit between the planar cable support members and the flat conductor cable to provide further strain relief for the interconnections between the conductors of the flat conductor cable and the terminal pins.

9 Claims, 7 Drawing Figures

ELECTRICAL CONNECTOR FOR TERMINATING A FLAT CONDUCTOR CABLE

The present invention relates to a new and improved electrical connector for terminating flat conductor cable, and more particularly an electrical connector which provides improved strain relief for the interconnections between the conductors of the flat conductor cable and the terminal pins of the connector.

Flat conductor cable is often employed in the formation of electrical jumpers for interconnecting a plurality of terminal pins in sophisticated electronic circuitry. One of the major problems associated with flat conductor cable jumpers is to provide sufficient strain relief for the electrical connections between the conductors and the end connector in that many times the jumper cable is abused by being withdrawn from the circuit board or the like by the operator pulling on the cable, rather than gripping the end connector. The axial stress applied to the connections between the terminal pins of the electrical connector and the conductors of the flat cable often exceeds the inherent strength of the soldered or crimped connections, thereby possibly causing an electrical discontinuity in the cable jumper.

Heretofore, in order to achieve strain relief for a termination of a flat conductor cable, after the conductors of the cable are soldered to the terminal pins, which is usually mounted in a holder member, the latter and the soldered connections are placed in a mold, and a potting liquid is poured into the mold in order to form a monolithic structure for the termination. The shortcomings associated with forming a potted end connector is that it is time consuming, requires extensive cleanup, it requires skilled labor to insure that the resulting molded element is of uniform density and construction, and thus it is expensive to manufacture. Another shorcoming of the potted form of electrical connector is that it is hard to control the thickness of the resulting molded element, and this is of particular concern when the jumper is employed in miniaturized electronics circuitry where space is extremely limited. Still further, potting often results in flash on the electrical connector which requires trimming, as well as resulting in a non-uniform size of the termination, with the potting process being very slow such that is does not lend itself to high productivity. Another shortcoming of the potting technique is that it is very difficult to repair a defective electrical connector made through the potting technique, without having to use chemicals to melt the potting away, and the use of such chemicals is both expensive and tedious. Thus, as a practical matter, if the potted electrical connector is defective, it is usually discarded, thereby further increasing the cost of production of potted electrical connectors.

Accordingly, it is an object of the subject invention to provide a new and improved electrical connector for terminating a flat conductor cable for the formation of an electrical jumper, and more particularly, an electrical connector which is readily connected to the conductors of a flat conductor cable, and which includes inherent strain relief means.

Another object is to provide an electrical connector that is readily assembled to a flat cable, and which may be readily disassembled for repair purposes.

It is a further object to provide a new and improved electrical connector which insures positive alignment of the conductors of the flat conductor cable to the connector terminal pins, and which is of uniform size and wherein the outer dimensions of the electrical connector are readily controlled.

It is still a further object of the subject invention to provide an electrical connector for terminating a flat conductor cable which may be readily assembled without requiring skilled labor, and which lends itself to high productivity.

The above and other objects and advantages of the invention are achieved by an electrical connector which is adapted to terminate an end of a flat conductor cable for forming an electrical jumper. The electrical connector basically comprises a carrier made of non-electrically conductive plastic material and including an elongated bar member which is adapted to receive a parallel array of terminal pins, and which bar member is formed unitary with two, generally planar cable support members. The latter are pivotally connected to the bar member by plastic hinges and are disposed on opposite sides of the socket portions of the terminal pins. The opposite ends of the terminal pins define posts which are adapted to engage a printed circuit board or other circuitry to which the electrical jumper is connected. Each planar support member is formed to include a plurality of elongated grooves which are spaced to correspond with the spacing of the conductors of the flat conductor cable. Ribs extending transverse to the longitudinally extending axes of the grooves are provided in each planar cable support member, with the ribs of the two support members cooperating to grip the conductor portions of the flat conductor cables in the assembled condition of the electrical connector for strain relief purposes. In the assembled condition of the electrical connector, the planar cable support members are disposed on opposite surfaces of the flat conductor cable, with the conductors being connected, such as by soldering, to the socket portions of the terminal pins. One cable support member may be provided with a plurality of holes, while the other planar support member may be provided with a plurality of projections, with the latter extending through the plastic carrier portions of the flat conductor cable intermediate the conductors, and engaging the holes of the other planar cable support member, thereby providing further strain relief for the electrical connector. A third form of strain relief is provided in that the grooves formed in the planar support members are of reduced cross-section relative to the cross-section of the conductors in the flat conductor cable, such that when the planar support members are secured to the opposite sides of the flat connector cable, the interference fit between the grooves in the carrier member and the conductors provides additional strain relief.

The socket portions of the terminal pins may be of conventional forked design for soldering to the conductors of the electrical cable, or the sockets may be configured to enable insulation piercing of the flat conductor cable by the socket portions, thereby reducing the assembly time of the electrical connector to the flat conductor cable.

Further objects and advantages of the invention will become apparent from the reading of the following detailed description taken in conjunction with the drawings in which.

Although the invention is described with respect to a conventional flat conductor cable commonly referred to as spectra-strip, wherein a plurality of round conductors, either of standard or solid wire are disposed in parallel array and maintained in spaced position by a covering of insulating material, it should be understood that the electrical connector of the subject invention may also be employed with other forms of flat conductor cables. For example, the subject invention may be employed to terminate flat conductor cable formed by a plurality of electrical conductors of generally rectangular cross-section embedded between two laminated sheets of insulation material, such that the opposed surfaces of the resulting flat conductor cable are flat, rather than of corrugated configuration, as in the case of spectra-strip.

Figure 1:
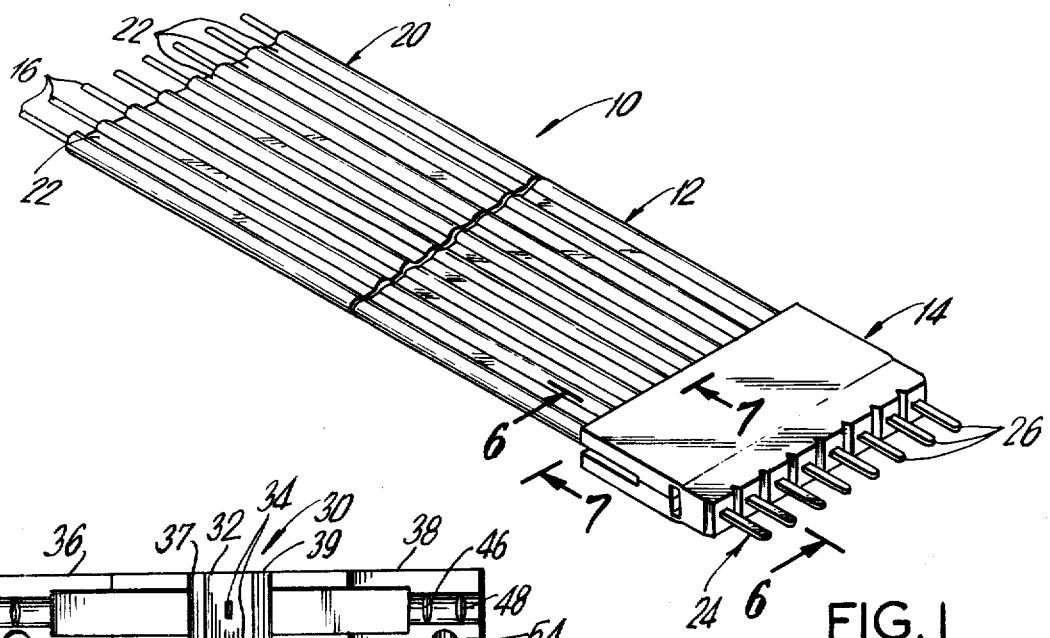
FIG. 1 is a perspective view of the flat conductor cable terminated at one end with an electrical connector made according to the subject invention.
Figure 4:
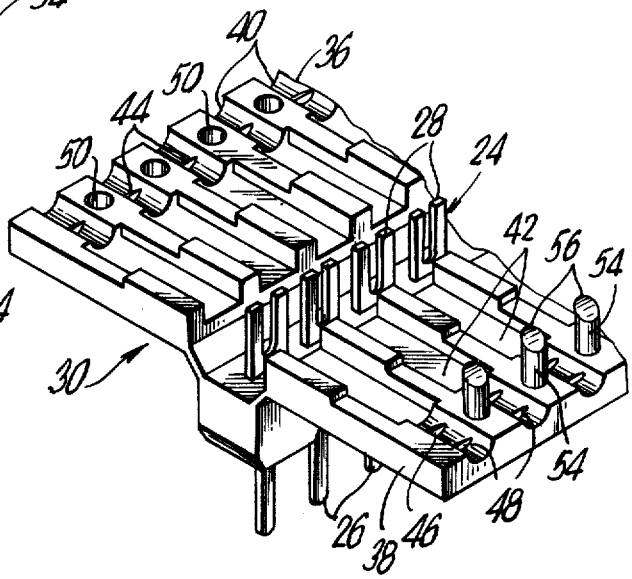
FIG. 4 is a perspective view of the electrical connector of the subject invention with the terminal pins being mounted in the carrier portion preparatory to assembly with a flat conductor cable.

Referring to FIG. 1, an electrical jumper for interconnecting electrical circuit components in a printed circuit board or the like is generally designated by numeral 10, and basically comprises a flat conductor cable 12 which may be terminated at one or both ends with an electrical connector 14. As shown in FIG. 1, the opposite end of the flat conductor cable 12 has exposed elongated, electrical conductors 16 that are stripped of insulation, and pretinned for soldering or crimped connection to leads on a printed circuit board. The electrical conductors 16 may be of round solid, or round stranded wire, and are embedded in an insulative sheet of plastic coverlayer material 20 for maintaining the electrical isolation of the parallel conductors 16. The flat conductor cable 12 thus has a generally corrugated cross-sectional configuration, and the insulated conductors 16 are spaced by intermediate insulation carrier portions, designated by the numeral 22. The electrical connector 14 includes terminal pins 24, the post portions 26 of which extend beyond the electrical connector 14 and are disposed in parallel array for insertion into a suitable socket provided in the printed circuit board or the like. As shown in FIG. 4, each terminal pin 24 includes a post portion 26, and a socket portion 28, the latter being disposed within the carrier 30 of the electrical connector 14. Carrier 30 is preferably formed by a unitary molding of thermoplastic material, such as glass filled polyester or glass filled nylon. Carrier 30 includes an elongated bar member 32 which is of generally rectangular cross-section, and includes a plurality of parallel apertures 34 extending therethrough. The terminal pins 24 are received within the apertures 34, preferably by a press-fit connection, with the post portions 26 of the terminal pins extending from one end of the bar member 32, and the socket portions 28 extending from the opposite end of the bar member 32. Formed unitary with the elongated bar member 32 are planar cable support members 36 and 38 which are hingedly connected to the elongated bar member 32 by plastic hinges, designated 37 and 39, respectively. The latter are disposed on opposite sides of the socket portions 28 of the terminal pins, and in the assembled condition of the electrical connector, the sockets 28 are encased within the carrier 30.

Figure 2:
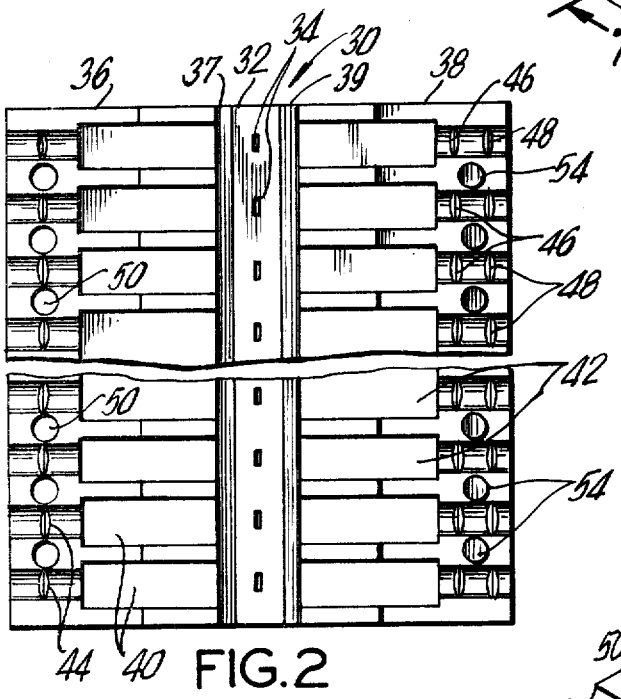
FIG. 2 is a plan view of the carrier portion of the electrical connector of the subject invention.

As shown in FIGS. 2 and 4, each planar support member 36, 38 include a plurality of elongated, generally parallel grooves 40, 42 which extend perpendicular to the longitudinal axis of the bar member 32. The elongated grooves 40, 42 are in parallel array, with the spacing between the grooves corresponding to the spacing between the conductors 16 of the flat conductor cable 12. At least a portion of each elongated groove 40, 42 is of hemispherical cross-section, the radius of which is slightly less than the radius of curvature of the insulated conductor 16 of the flat conductor cable for strain relief purposes, as more fully described hereinafter. Each groove 40 in the planar support member 36 includes a rib 44 which extends perpendicular to the longitudinal axis of the associated groove, while each groove of the planar support member 38 includes two parallel, spaced ribs 46, 48, which also extend perpendicular to the longitudinal axis of the associated groove. In the assembled condition of the electrical connector 14, the ribs 44, 46 and 48 are staggered and engage the insulated conductors 16 in order to provide additional strain relief to the electrical connector 14, as more fully described hereinafter.

Figure 3:
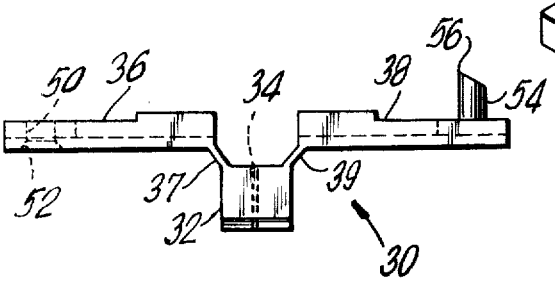
FIG. 3 is an end elevational view of the carrier portion of the electrical connector of the subject invention.

The planar cable support member 36 also includes a plurality of through holes 50 which are disposed intermediate the grooves 40 and extend perpendicular to the plane of the cable support member 36. As shown in FIG. 3, each hole 50 may be countersunk as at 52. A corresponding plurality of projections 54 are formed unitary with the planar cable support member 38, and are disposed intermediate the grooves 42. As shown in FIGS. 3 and 4, each projection 54 may be pointed as at 56, with the diameter of each projection 54 preferably corresponding to or being slightly greater than the diameter of the associated hole 50 in the planar cable support member 36. In the assembly of the electrical connector 14, the projections 54 extend through the intermediate insulation carrier portions 22 of the flat conductor cable 12 and into the associated holes 50 to form means for securing the two generally planar cable support members 36 and 38 in the folded-over position against the opposite surfaces of the flat conductor cable 12. The interengagement of projections 54 and flat cable 12 provide still another means for strain relief to the electrical connector 14.

Figure 5:
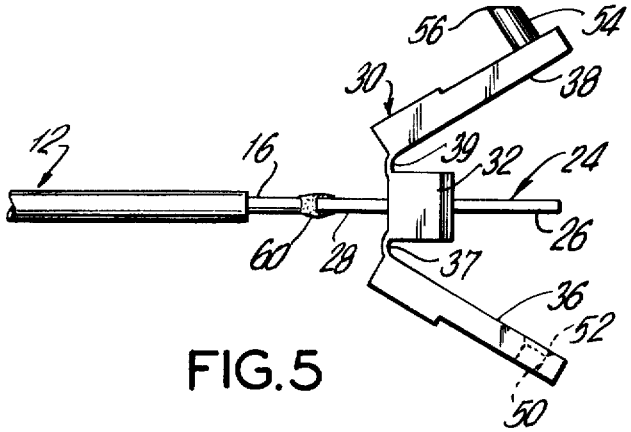
FIG. 5 illustrates the disposition of the electrical connector of the subject invention at the time when the electrical conductors of the flat conductor cable are secured to the terminal pins.

In the assembly of the electrical jumper 10, first, one end of the flat conductor cable 12 is stripped of insulation to expose the elongated, parallel conductors 16, after which the latter are pretinned preparatory to soldering. The posts 26 of the terminal pins 24 are inserted into the apertures 34 in the carrier 30 until the shoulders of the socket portions 28 bear against the elongated bar member 32. Next, the socket portions 28 of the terminal pins 24 are respectively secured, such as by soldering, to the conductor 16 of the flat conductor cable 12. To facilitate the soldering operation, especially in view of the close spacing between the sockets 28, usually on the order of 100 mils, the planar cable support members 36 and 38 are pivoted about the plastic hinges 37 and 39 so as to overlie the bar member 32 and the parallel posts 26 of the terminal pins 24. At such time, the disposition of the carrier member 30 is as shown in FIG. 5, and it is seen that there is complete, unobstructed access to the sockets 28, thereby facilitating interconnection of the individual conductors 16 to the individual sockets 28 such as by a soldered connection, as designated at 60 in FIGS. 5 and 6. After the soldering operation is completed, the electrical connectors can be readily tested for shorts and for continuity. Next, the planar cable support members 36 and 38 are pivoted about the plastic hinges 37 and 39 so as to engage the opposite surfaces of the flat conductor cable 12, with the pointed projections 54 piercing through the intermediate insulation carrier portions 22 of the flat conductor cable 12 and then engaging the holes 50 in the opposed cable support member 36.

By virtue of the parallel grooves 40, 42 in the carrier 30, as the planar cable support members 36 and 38 intimately engage the surfaces of the flat conductor cable, positive alignment of the insulated conductors 16 within the carrier 30 is achieved. When the projections 54 are inserted into the opposed holes 50, the electrical connector may be placed in a standard arbor press. As pressure is applied to the connector, the pointed ends 56 of the projections 54 which extend beyond the outer surface of the support member 34 are deformed to effectively form a plastic rivet securement means between the opposed support members 36 and 38. The deformed, flattened ends of the projections 54 are accommodated within the countersunk portions 52 of the holes 50, whereby the resulting electrical connector has a substantially flat surface on opposite surfaces thereof, thereby maintaining the required dimensional tolerance of the electrical connector 14. Additional securing means between the opposed planar cable support members 36 and 38 may be provided by suitable adhesive.

Figure 6:
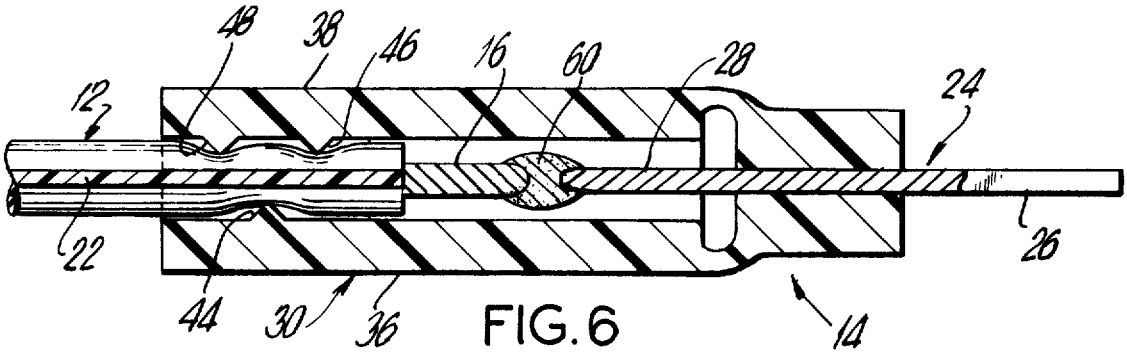
FIG. 6 is a cross-sectional view taken along line 6—6 of FIG. 1.

As shown in FIG. 6, the soldered connection 60 between the electrical conductors 16 and the terminal pins 24 are wholly disposed within the electrical connector 14. At such times, the staggered ribs 44, 46, and 48 provide an effective clamp for gripping the insulated conductors 16, thereby providing strain relief against axial force applied to the flat conductor cable, and thus minimizing the imposition of axial loads on the soldered connections 60.

Figure 7:
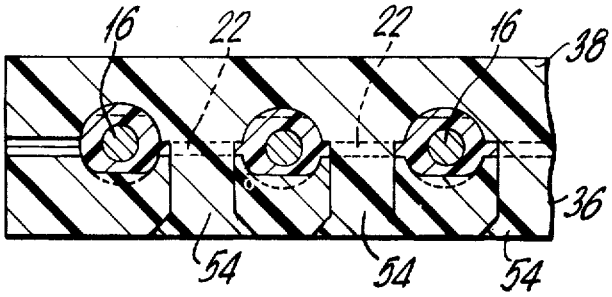
FIG. 7 is a cross-sectional view taken along line 7—7 in FIG. 1.

As shown in FIG. 7, the projections 54 extend through the intermediate insulation carrier portions 22 of the flat conductor cable 12. Thus, any axial load on the flat conductor cable would be restrained by the interconnection between the projections 54 and the insulation carrier of the flat conductor cable. A third form of strain relief of the electrical connector 14 is achieved by virtue of the intimate engagement of the planar cable support members 36 and 38 and the flat conductor cable 12. More particularly, since the grooves 40 and 42 of the support members 36 and 38 are of smaller cross-section than the corresponding corrugated configuration of the flat conductor cable, an interference fit is achieved between the electrical connector 14 and the flat conductor cable, thereby providing still further strain relief to the soldered connections 60.

Accordingly, there is provided a new and improved electrical connector for terminating a flat conductor cable, which electrical connector has inherent strain relief, is simple to install, and may be readily disassembled if required. Furthermore, the grooved configurations of the planar cable support members aids in maintaining the electrical isolation of the various conductors relative to the adjacent conductors in that the conductors of the cable are maintained on true pitch thereby enhancing the electrical characteristics in the cable so that the impedance will remain constant.

Although the invention has been described with respect to one preferred embodiment, it is readily apparent that various modifications or alterations of the subject electrical connector may be made by one skilled in the art without departing from the spirit and scope of the invention. As an example, the terminal post 26 of the terminal pins 24 may be of female socket design, while the socket portions 28 of the terminal posts may be suitably configured to achieve insulation piercing of the flat conductor cable 12, thereby obviating the requirement for soldered connections between the terminal pins 24 and the conductors 16 of the flat conductor cable. Still further, in certain applications where it is desired to interconnect certain conductors 16 of the flat conductor cable, such interconnections may be effected at the soldered connections 60, with the programmed interconnections being wholly disposed within the carrier 30 of the electrical connector 14.

What is claimed is:

1. An electrical connector for terminating a flat conductor cable comprising:

a plurality of terminal pins, each having a post portion and a socket portion;

a carrier made of non-electrically conductive material including (1) an elongated bar member having a plurality of parallel apertures extending therethrough for receiving a parallel array of said terminal pins, with the post portion of each terminal pin extending from one side of the bar member while the socket portion thereof extends from the opposite side of the bar member, and (2) two, generally planar cable support members formed unitary with the bar member and hingedly connected thereto, said planar support members being respectively disposed on opposite sides of the array of socket portions of the terminal pins such that after the conductors of the flat conductor cable are connected to said socket portions, the planar support members may be folded over so as to engage the opposed sides of the flat conductor cable, with the side of each said planar cable support member which engages the flat conductor cable including a plurality of elongated parallel grooves, the cross-sections of which are smaller than the cross-sections of the conductor portions of the flat conductor cable such that strain relief is provided by the interference fit between the planar cable support members and the flat conductor cable, and wherein ribs extending transverse to the longitudinal axes of said parallel grooves are provided in said grooves, the ribs in the opposed generally planar cable support members being located for engaging the individual conductors of the flat conductor cable in staggered relationship to thereby provide strain relief; and means for securing said two generally planar cable support members in folded-over position against the opposite surface of said flat conductor cable, said means including in one cable support member a plurality of holes, while the other planar support member includes a plurality of projections, said projections upon assembly of the electrical connector extending through the insulation carrier material intermediate the conductors of said flat conductor cable and into said holes to engage the opposed planar support member thereby providing strain relief to the connector.

2. An electrical connector for terminating a flat conductor cable as in claim 1 wherein each projection is of sufficient length to extend completely through and beyond the outer surface of the opposed planar support member, with each said projection being deformed to form a riveted connection for maintaining said planar support members in fixed relationship.

3. An electrical connector for terminating a flat conductor cable as in claim 1 wherein each projection is of greater cross-section than the associated hole in the opposed cable support member so as to result in an interference fit between said projection and the opposed planar support member.

4. An electrical connector for terminating a flat conductor cable as in claim 1 wherein each of said projections includes a pointed end for facilitating insulation piercing of the flat conductor cable.

5. An electrical connector for terminating a flat conductor cable as in claim 1 wherein said means for securing said planar support members in folded-over position against saif flat conductor cable comprises an adhesive material.

6. An electrical connector for terminating a flat conductor cable as in claim 1 wherein the conductors of the flat conductor cable are soldered to the socket portions of the terminal pins.

7. An electrical connector for terminating a flat conductor cable as in claim 1 wherein said elongated bar member is of generally rectangular cross-section.

8. An electrical connector for terminating a flat conductor cable as in claim 1 wherein said carrier is molded and is made of a thermoplastic material.

9. An electrical connector for terminating a flat conductor cable as in claim 8 wherein said thermoplastic material is glass filled polyester.

* * * * *